United States Patent [19]

Schneider et al.

[11] 4,067,458

[45] Jan. 10, 1978

[54] APPARATUS FOR THE UNSTACKING AND TRANSPORTATION OF BLANKS

[75] Inventors: Franz Schneider, Goppingen; Karl Maier, Kuchen; Gerhard Tappen, Wangen, all of Germany

[73] Assignee: L. Schuler GmbH, Germany

[21] Appl. No.: 711,973

[22] Filed: Aug. 5, 1976

[30] Foreign Application Priority Data

Aug. 5, 1975 Germany ..... 2434819

[51] Int. Cl.[2] ..... B65G 59/04

[52] U.S. Cl. ..... 214/8.5 D; 214/6 M; 214/650 SG; 271/9; 271/64; 271/193; 271/263

[58] Field of Search ..... 214/8.5 D, 1 BT, 6 FS, 214/650 SG, 6 M; 271/5, 9, 64, 193, 262, 263; 294/65

[56] References Cited

U.S. PATENT DOCUMENTS

| | | | |
|---|---|---|---|
| 1,282,477 | 10/1918 | Smith | 294/65 |
| 1,373,997 | 4/1921 | Debaecker | 294/65 |
| 3,288,462 | 11/1966 | Liva | 271/263 |
| 3,404,789 | 10/1968 | Georgeff | 214/8.5 D |
| 3,603,463 | 9/1971 | Billett | 214/6 M X |

*Primary Examiner*—Robert J. Spar
*Assistant Examiner*—George F. Abraham
*Attorney, Agent, or Firm*—Craig & Antonelli

[57] ABSTRACT

Apparatus for the unstacking and transportation of blanks into a subsequently arranged operating chamber of a processing machine, wherein the blanks are transferred from a stack of blanks, by hoisting devices, especially suction bridges, includes a suspended conveyor which conveys the blanks by way of a double-blank control device to a centering station. From the centering station, the blanks, centered in their position, are transferrable into the operating chamber, optionally by way of an intermediate station. At least two stacks of blanks are disposed in series in the conveying direction of the blanks on at least two elevator carts movable at right angles to the conveying direction. Each elevator cart is associated with a separately operable suspended conveyor with associated hoisting units. A further, continuously driven suspended conveyor is provided downstream of the double blank control device which conveyor spans a double-blank depositing unit and terminates over the zone of the centering station.

10 Claims, 2 Drawing Figures

APPARATUS FOR THE UNSTACKING AND TRANSPORTATION OF BLANKS

FIELD OF THE INVENTION

This invention relates to an apparatus for the unstacking and transportation of blanks.

BACKGROUND OF THE INVENTION

Such an apparatus has been described in U.S. Pat. No. 3,404,789. In this apparatus the stacks of blanks are brought successively by means of a conveyor into an unstacking station where individual blanks are lifted off the blank stack by means of hoisting mechanisms, especially suction bridges, and are transferred to a magnetically controlled suspended conveyor. From the suspended conveyor, the blanks pass via a double-blank control device into a centering station and, by way of another intermediate station provided thereafter, into the working chamber of a processing machine, for example a first press of an automated press line. The centering and intermediate stations are loaded and/or unloaded in the operating cycle of the processing machine to be supplied. If, in this apparatus, a double blank is conveyed by the suspended conveyor, then the double-blank control device responds and the double blank, deposited in the meantime in the centering station, is separated. This is accomplished by moving the centering station away by pivoting, whereby the double blank is transferred to an additional roller conveyor train and deposited on a double-blank depository. The elimination of double blanks requires, in this conventional device, an expensive construction and, furthermore, results in a production pause, since the unstacking process is controlled in direct dependence on the operating cycle of the processing machine. A further production loss is incurred due to the fact that, after a stack of blanks has been unstacked, the apparatus must be arrested until a new stack of blanks has been introduced underneath the hoisting mechanism.

SUMMARY OF THE INVENTION

The invention is based on the objective of providing an apparatus for the unstacking and transportation of blanks of the aforedescribed type wherein production pauses and, thus, production losses due to the elimination of double blanks and/or blank stack exchange are extensively avoided.

The advantages of an apparatus in accordance with the invention reside particularly in a relatively simple mechanical construction and substantially in an unstacking velocity which is higher as compared to the operating cycle of the processing machine, whereby gaps in the production due to the elimination of double blanks are avoided. Furthermore, a smooth transition during a change of a blank stack is ensured, since, after one stack of blanks has been unstacked, an already prepared, subsequent stack of blanks can be unstacked continuously by switchover, while the elevator cart, relieved of its stack of blanks, is exchanged for another one carrying a new stack of blanks.

In this connection, the arrangement of the present invention makes use of the conventional feature of arranging, in the conveying direction of the blanks, several elevator carts in succession. Such a system has been disclosed, for example, in German Unexamined Laid-Open Application No. 2,123,870, wherein this device is utilized particularly for the deposition of graded stacks of blanks, for example in accordance with quality features.

DETAILED DESCRIPTION

Figure 1:
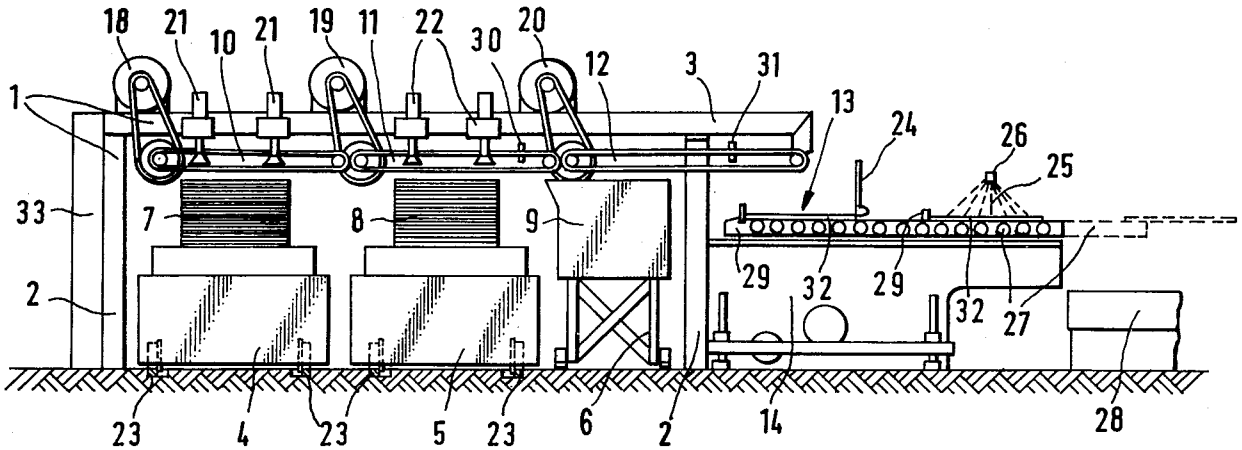
FIG. 1 shows a lateral view of a transporting and unstacking apparatus.
Figure 2:
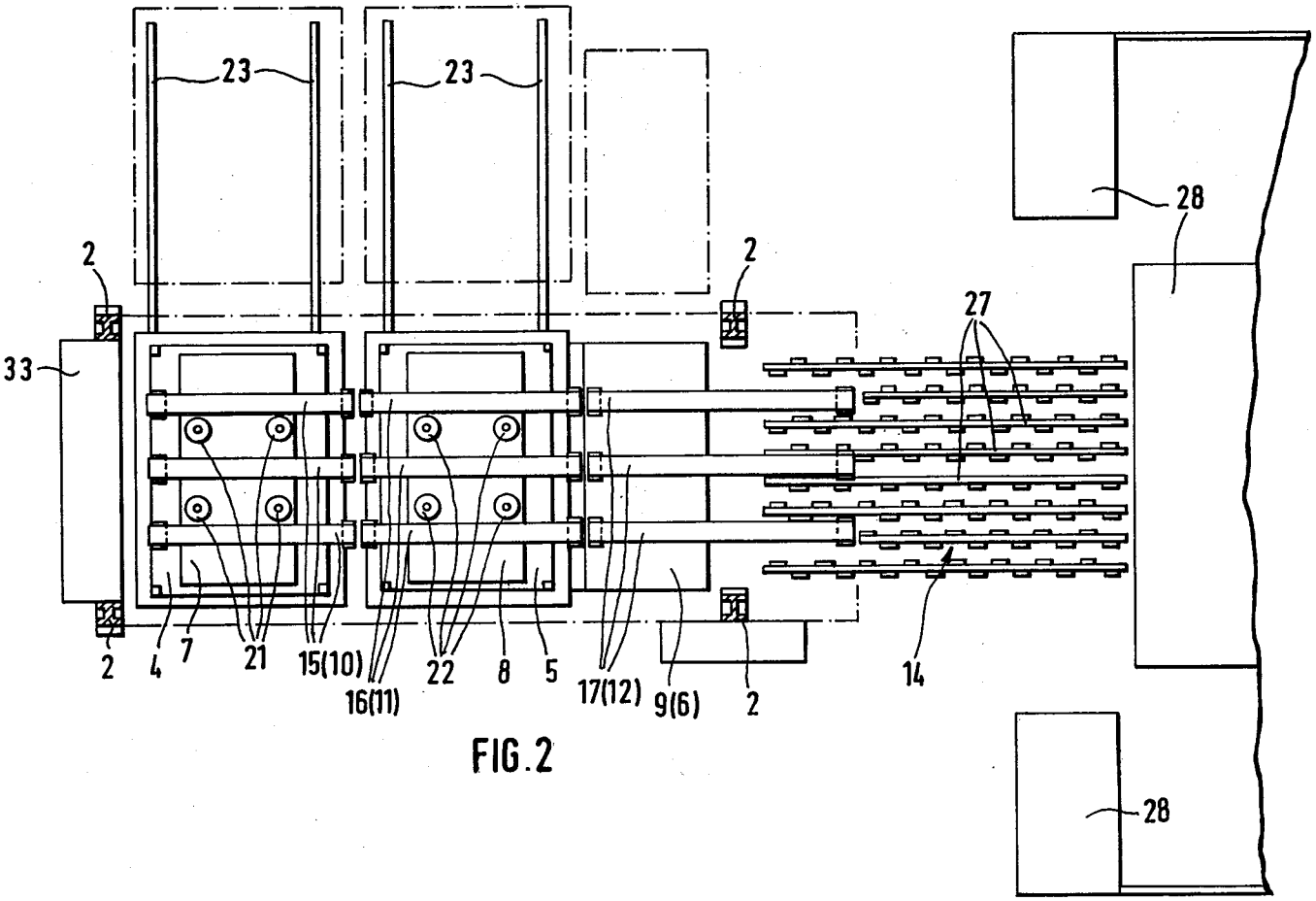
FIG. 2 shows a top view of the apparatus of FIG. 1.

With reference to FIGS. 1 and 2, the apparatus is constructed of a supporting frame 1, consisting of vertical supporting columns 2 and horizontal longitudinal girders 3. Between the supporting columns 2 and underneath the longitudinal girders 3, two elevator carts 4, 5 and a depository cart 6 for double blanks to be segregated are arranged, as seen in the conveying direction and being displaceable at right angles to the conveying direction. The stacks 7, 8 of blanks to be unstacked are arranged on the elevator carts 4, 5, whereas the depository cart 6 carries a collecting contanier 9 for the segregated double blanks. Each of the two elevator carts 4, 5 is associated with a respective suspended conveyor 10, 11. A further suspended conveyor 12 follows, as seen in the conveying direction, after the suspended conveyor 11, spans the depository cart 6 for the double blanks and terminates over the zone of a centering station 13, which latter is part of a ratchet and pawl feed mechanism 14, which will be described in greater detail below. The suspended conveyors 10, 11 are fashioned as magnetic conveyor belts with a constant attractive action and consist of respectively three bands 15, 16 arranged in parallel at mutual spacings. The additional suspended conveyor 12 consists of bands 17 arranged in the same way and is likewise constructed as a magnetic conveyor belt, but in this case the attraction effect is controllable, i.e., it can be switched on and off. Each suspended conveyor 10, 11, 12 is associated with a separately controllable drive mechanism 18, 19, 20. The drive mechanisms 18, 19, 20 are preferably supported on the horizontal longitudinal girders 3 (FIG. 1). Between the bands 15 of the suspended conveyor 10, elevator means in the form of suction bridges 21 operating with the aid of vacuum are arranged, which are movable in the vertical direction, and the mutual spacing of which is adjustable in the horizontal direction. In the same way, additional suction bridges 22 are provided between the bands 16 of the suspended conveyor 11. The exact positioning of the elevator carts 4, 5 and the stacks 7, 8 of blanks disposed thereon is ensured by rails 23 disposed at right angles to the conveying direction and the length of which is chosen so that the elevator carts 4, 5 can be moved out from under the suspended conveyors 10, 11.

As mentioned above, the additional suspended conveyor 12 terminates over the zone of the centering station 13 of the ratchet and pawl feed mechanism 14. Such ratchet and pawl feed mechanisms 14 have been known, in principle, for a long time and have been described in their basic structure, for example, in German Pat. No. 535,945 and U.S. Pat. No. 1,346,589. A resilient stop 24 is arranged in the conveying direction behind the centering station 13; this stop can be mounted, for example, to the rachet and pawl feed mechanism 14 or to the supporting frame 1. An intermediate station 25 follows the centering station 13; in the presently described embodiment, a spraying device 26 is disposed above this intermediate station. The centering station 13 and the intermediate station 25 are arranged on roller tracks 27 associated with the ratchet and pawl feed mechanism 14; these tracks are fashioned to be adjustable in length at the front end. By means of this adjustment feature, it is possible to bridge the distance between the ratchet and pawl feed mechanism 14 and a tool, not illustrated in detail, of a first press 28 of an automated press line. Between the roller tracks 27, feed pawls 29 are disposed which are movable in the horizontal direction and which are vertically controllable. Braking and centering rails, not shown in detail, complete the ratchet and pawl feed mechanism 14. The power for driving and controlling the ratchet and pawl feed mechanism 14 is derived from the drive mechanism and control means of the first press 28.

A double blank control device 30 is arranged in front of the additional suspended conveyor 12 and the collecting container 9 for the double blanks, in the zone of the suspended conveyor 11. A further switching unit 31, variable in its position, is located in the zone of the suspended conveyor 12 and serves for controlling the attraction power of the suspended conveyor 12.

The operation of the apparatus for the unstacking and transportation of blanks 32 as described hereinabove takes place as follows.

It is assumed that the unstacking process begins with the stack 7 of blanks disposed on the elevator cart 4. The suction bridges 21 extending in between the bands 15 of the suspended conveyor 10 are adjusted until they come into contact with the uppermost blank 32 of the stack 7 of blanks. In order to lift the blank 32, a vacuum device associated with the suction bridges 21 and accommodated in a control stand 33 located at the end of the supporting frame 1 is activated. The lifting of the blank 32 is facilitated, as conventional, by suitably arranged spreader magnets which are not shown in detail. Furthermore, the external suction elements of the suction bridges 21 are activated earlier as compared to the central suction elements so that the blank 32 to be lifted off is bent in a saber-like fashion. By the saber-like bending of the blank 32, the separation of the blank 32 to be unstacked from the stack 7 of blanks is essentially facilitated. After the blank has been lifted off, the suction bridges 21 move upwardly, the suction elements being controlled in such a way that the blank 32 again assumes a planar position and can be transferred to the stationary bands 15 of the suspended conveyor 10. With the transfer of the blank 32 to the suspended conveyor 10, the drive mechanisms 18, 19 are placed in operation, so that the blank 32 is conveyed from the suspended conveyor 10 to the suspended conveyor 11, is transferred to the latter, and, while passing the double blank control means 30, is conveyed to the additional suspended conveyor 12. The suspended conveyor 12 is constantly driven by the drive mechanism 20 and transports the blank 32 over the zone of the centering station 13 of the ratchet and pawl feed mechanism 14. By means of the switching unit 31, the position of which is adjusted in dependence on the size of the blanks 32, the attraction power of the suspended conveyor 12 is controlled so that the blank 32 falls into the centering station 13 of the ratchet and pawl feed mechanism 14. The resilient stop 24 ensures, during this step, that the blank 32 falling from the suspended conveyor 12 will pass with certainty into the centering station 13. The blank 32, centered in the centering station 13, is conveyed by the feed pawls 29, in dependence on the operating cycle of the first press 28, into the intermediate station 25 and then into the operation chamber of the first press 28. The blank 32, which as arrived in the intermediate station 25, is sprayed by means of the spraying unit 26 with a lubricant, e.g., an oil emulsion, for the drawing step to be conducted in the first press 28. During the transport of the blank 32 on the ratchet and pawl feed mechanism 14, the blank 32 is exactly aligned by the braking and centering rails until the blank is transferred into the operating chamber of the first press 28 and thus brought into the correct position.

As soon as the blank 32 has been transferred from the suspended conveyor 10 to the suspended conveyor 11, the drive mechanism 18 of the suspended conveyor 10 is turned off, and the suction bridges 21 lift the subsequent blank 32 from the stack 7 of blanks in the manner described hereinabove and transfer same to the presently stationary suspended conveyor 10. As soon as the preceding blank 32 has been transferred from the centering station 13 into the intermediate station 25, the suspended conveyor 10 with the blank 32 adhering thereto is activated so that the blank 32 is transported, in the way set forth above, into the empty centering station 13. Once the stack 7 of the blanks has been unstacked, the apparatus switches over automatically to the stack 8 of blanks disposed on the elevator cart 5. The unstacking process continues without the occurrence of a production or conveying gap. The suspended conveyor 10 is not driven, and the elevator cart 4 can be moved out and provided with a new stack 7 of blanks. The elevator cart 4 is then moved inwardly again with the new stack 7 of blanks, so that the apparatus can automatically switch over again to the unstacking of the stack 7 of blanks as soon as the stack 8 of blanks has been unstacked. The elevator cart 5 is provided with a new stack 8 of blanks, as described above in connection with the elevator cart 4. It can be seen that a continuously progressing production flow is attained in this way.

During the unstacking step, the elevator carts 4 and/or 5 are adjusted vertically in accordance with the progressing unstacking operation, so that the uppermost blank 32 on the stack 7 or 8 of blanks is always at a minimum spacing from the bands 15 or 16 of the suspended conveyor 10 or 11. One designed for such an elevator cart 4, 5 is disclosed, for example in Directions from the Association of German Engineers 3254,p. 16. By this measure, an optimally rapid unstacking operation is attained, whereby the occurrence of production gaps by the elimination of double blanks is more readily avoidable.

To avoid damage to the first press 28 and/or to a tool, double blanks which are in some cases removed from the stack must be segregated. For this purpose, the double-blank control device 30, operation on a non-contact basis, is provided in the region of the suspended conveyor 11. The double-blank control devive 30 registers a double blank and causes the attraction power of the suspended conveyor 12 to cease, whereby the double blank is discarded into the collecting container 9 for the double blanks provided on the depositing cart 6. Since the centering station 13 of the ratchet and pawl feed mechanism 14 remains unobstructed by the discarding of the double blank, the subsequent unstacking and conveying process is begun, in case the unstacking is effected from the stack 8 of blanks, immediately with the discarding of the double blank, so that a blank 32 passes into the centering station 13 before the ratchet and pawl feed mechanism 14 is operated by the first press 28 and switched further by a conveying step. No production gap has occurred. In case the unstacking takes place from the stack 7 of blanks, the unstacking step following the double blank has already been initiated, independently of the response of the double blank control device 30, so that directly with the discarding of the double blank, the drive mechanism 18 of the suspended conveyor 10 is started up and the blank 32 is conveyed into the centering station 13 of the ratchet and pawl feed mechanism 14. Thus, a gap in the production is also avoided in this instance.

The unstacking and conveying operation for the blanks 32 is controlled, in the apparatus described hereinabove, primarily by the occupancy of the centering station 13 of the ratchet and pawl feed mechanism 14, whereas the feeding speed of the ratchet and pawl feed mechanism 14 is dependent on the operating velocity of the first press 28. The fact that the speed of the unstacking and conveying operation is higher than that of the operating cycle of the first press 28 and that the control of the unstacking and conveying operation is only indirectly dependent on the first press 28 makes it possible to avoid production gaps in case of a double blank elimination, as described hereinabove.

The higher velocity of the unstacking and conveying operation as compared to the operating cycle of the first press 28 and thus also of the ratchet and pawl feed mechanism 14, which, as set forth above, is driven in dependence on the operating cycle of the first press 28, results from the higher conveying speed of the suspended conveyors 10, 11, 12 as well as from the immediate initiation of an unstacking process by means of the suction bridges 21, 22 as soon as a blank 32 conveyed by one of the suspended conveyors 10, 11 has left such conveyor.

Furthermore, it is also possible to arrange, in place of respectively one stack 7, 8 of blanks, also respectively two stacks of blanks on each elevator cart 4, 5. In this case, the two stacks of blanks per elevator cart 4, 5 are unstacked alternatingly, by making the suction elements of the suction bridges 21, 22 arranged in series at right angles to the conveying direction, controllable separately from one another. The alternating unstacking operation ensures an approximately uniform distance of the two stacks of blanks with respect to the suction bridges 21, 22.

While we have shown and described several embodiments in accordance with the present invention, it is understood that the same is not limited thereto but is susceptible of numerous changes and modifications as known to a person skilled in the art, and we therefore do not wish to be limited to the details shown and described herein but intend to cover all such changes and modifications as are obvious to one of ordinary skill in the art.

We claim:

1. In an apparatus for the unstacking and transportation of blanks into the operating chamber of a processing machine, wherein the blanks are transferred from a stack of blanks, by means of hoisting devices to a suspended conveyor system, which conveys the blanks by way of a double blank control device to a centering station from which the blanks, centered in their position, are transferrable into said operating chamber by way of an intermediate station, the improvement comprising:

at least two elevator carts, movable at right angles to the direction of blank transport by said conveyor system, upon which respective stacks of blanks are disposed, said carts being arranged in series in the direction of blank transport by said conveyor system, each cart being associated with a respective separately operable suspended conveyor element and associated hoisting units, said hoisting units being adjustable in position in accordance with the dimensions of the blanks to be unstacked and including a plurality of suction elements to which the blank to be unstacked adheres, and means, coupled to said suction elements, for activating those suction elements adjacent to the periphery of the blank prior to activating those suction elements adjacent the central portion of the blank, whereby a respective blank to be unstacked is separated from the stack upon which it is disposed starting with the outer portion of the blank.

2. The improvement according to claim 1, wherein said conveyor system is composed of a plurality of serially arranged conveyor elements to which the blanks being transferred adhere during transport, and wherein the degree of adherence between that conveyor element which is disposed above said double-blank depositing unit and the blank transported thereby is controllable.

3. The improvement according to claim 1, wherein the transport speed of said conveyor system is controllable so as to enable the rate of unstacking and transfer of said blanks to exceed the rate of operation of said processing machine, and thereby eliminate delays which would otherwise result from the removal of a double-blank.

4. The improvement according to claim 1, further comprising:

a double-blank depositing unit disposed downstream of said double-blank control device, beneath said suspended conveyor system, and upstream of said centering station; and wherein said double-blank control device is coupled to said conveyor system so as to cause said conveyor system, upon detection of a double blank being transferred, to discard said double blank into said double-blank depositing unit, and thereby prevent transfer of a double-blank to said centering station.

5. The improvement according to claim 4, wherein said conveyor system is composed of a plurality of serially arranged conveyor elements to which the blanks being transferred adhere during transport, and wherein the degree of adherence between that conveyor element which is disposed above said double-blank depositing unit and the blank transported thereby is controllable.

6. The improvement according to claim 4, wherein the suspended conveyor elements associated with the elevator carts have a continuously maintained adherent action.

7. The improvement according to claim 6, wherein the adherent action provided by that conveyor element which is disposed above said double-blank depositing unit is controlled by said double-blank control device.

8. The improvement according to claim 7, wherein the positions of the hoisting units are adjustable in accordance with the dimensions of the blanks to be unstacked.

9. In an apparatus for the unstacking and transportation of blanks into the operating chamber of a processing machine, wherein the blanks are transferred from a stack of blanks, by means of hoisting devices to a suspended conveyor system, which conveys the blanks by way of a double blank control device to a centering station from which the blanks, centered in their position, are transferrable into said operating chamber by way of an intermediate station, the improvement comprising:

at least two elevator carts, movable at right angles to the direction of blank transport by said conveyor system, upon which respective stacks of blanks are disposed, said carts being arranged in series in the direction of blank transport by said conveyor system, each cart being associated with a respective separately operable suspended conveyor element and associated hoisting units, said suspended conveyor elements associated with the elevator carts having a continuously maintained adherent action, a double-blank depositing unit disposed downstream of said double blank control device, beneath said suspended conveyor system, and upstream of said centering station, said double blank control device is coupled to said conveyor system so as to cause said conveyor system, upon detection of a double blank being transferred, to discard said double blank into said double-blank depositing unit and thereby prevent transfer of a double blank to said centering station, said conveyor system is composed of a plurality of serially arranged conveyor elements to which the blanks being transferred adhere during transport, and wherein the degree of adherence between that conveyor element which is disposed above said double-blank depositing unit and the blank being transported thereby is controllable by said double blank control device, said hoisting units being adjustable in position in accordance with the dimensions of the blanks to be unstacked, and wherein each hoisting unit comprises a plurality of suction elements to which the blank to be unstacked adheres, and means, coupled to said suction elements, for activating those suction elements adjacent to the periphery of the blank prior to activating those suction elements adjacent the central portion of the blank, whereby a respective blank to be unstacked is separated from the stack upon which it is disposed starting with the outer portion of the blank.

10. The improvement according to claim 9, wherein the transport speed of said conveyor system is controllable so as to enable the rate of unstacking and transfer of said blanks to exceed the rate of operation of said processing machine, and thereby eliminate delays which would otherwise result from the removal of a double-blank.

* * * * *